United States Patent [19]

Ross et al.

[11] 4,324,106

[45] Apr. 13, 1982

[54] REFRIGERATION SYSTEM

[75] Inventors: Robert R. Ross, Wheaton; Daniel R. Bansch, St. Charles, both of Ill.

[73] Assignee: H. A. Phillips & Co.

[21] Appl. No.: 193,748

[22] Filed: Oct. 3, 1980

[51] Int. Cl.[3] ..... F25B 41/00

[52] U.S. Cl. ..... 62/197; 62/509; 62/510

[58] Field of Search ..... 62/509, 510, 512, 117, 62/197, 174

[56] References Cited

U.S. PATENT DOCUMENTS

| | | | |
|---|---|---|---|
| 2,841,962 | 7/1958 | Richards | 62/174 |
| 2,966,043 | 12/1960 | Ross | 62/174 |
| 3,159,008 | 12/1964 | Nebgen | 62/512 |
| 3,315,484 | 4/1967 | Ross | 62/174 |
| 3,353,367 | 11/1967 | Garland et al. | 62/174 |
| 3,427,819 | 2/1969 | Seghetti | 62/509 |
| 3,636,723 | 1/1972 | Kramer | 62/197 |
| 3,919,859 | 11/1975 | Ross | 62/509 |
| 3,988,904 | 11/1976 | Ross | 62/509 |
| 4,059,968 | 11/1977 | Ross | 62/510 |
| 4,151,724 | 5/1979 | Garland | 62/175 |

FOREIGN PATENT DOCUMENTS

| | | | |
|---|---|---|---|
| 214949 | 5/1961 | Austria | 62/509 |

*Primary Examiner*—Ronald C. Capossela

*Attorney, Agent, or Firm*—Hume, Clement, Brinks, Willian & Olds, Ltd.

[57] ABSTRACT

An improvement in a recirculating refrigeration system which includes an "economizer" compressor. The economizer compressor is in a flash gas handling subsystem which receives flash gas from the primary system at a substantially higher input pressure than the primary compressor. As a result the load on the primary system compressor is reduced. The overall effect is a more efficient system, using less power.

3 Claims, 2 Drawing Figures

REFRIGERATION SYSTEM

FIELD OF THE INVENTION

This invention is in the field of refrigeration. It relates particularly to refrigeration systems of the large, industrial type.

BACKGROUND OF THE INVENTION

As pointed out in the specification of one of the applicants earlier U.S. Pat. No. 4,059,968, assigned to the same assignee as the present invention, the H. A. Phillips & Co., Chicago, Ill., the assignee has long been a leader in the design, development and installation of industrial type refrigeration systems. H. A. Phillips & Co. has been a pioneer in recirculating systems and numerous patents have issued to it covering these systems over the past thirty years. These include Phillips U.S. Pat. No. 2,570,979; Phillips U.S. Pat. No. 2,589,859; Phillips U.S. Pat. No. 2,641,281; Richards, Pat. No. 2,841,962; Richards et al. U.S. Pat. No. 2,871,673; Ross Pat. No. 2,966,043; Ross Pat. No. 3,315,484; and the aforementioned Ross patent.

In each of these recirculating systems, as well as in other recirculating systems presently in use, the system disclosed in the Garland U.S. Pat. No. 4,151,724, for example, relatively high pressure flash gas which is formed in the system receiver is returned to the normal system compressor operating at a lower pressure level than the receiver. (The normal system compressor must compress this flash gas from low pressure up to condensing pressure.) Such systems have been efficient enough for the low cost energy of the past. However, the rapidly increasing cost of energy coupled with the normal propensity of refrigeration systems to use energy at a prodigous rate, as well as wider use of such systems, have caused the industry to seek more economical systems for several years.

SUMMARY OF THE INVENTION

A primary object of the present invention is to provide an improvement in a recirculating refrigeration system which produces substantial energy savings. Another object is to provide an improvement in a recirculating refrigeration system which reduces power required by the system through the use of an economizer compressor which receives flash gas from the system receiver at a relatively high pressure. Still another object is to provide an improvement in a recirculating refrigeration system which produces a source of hot gas at relatively high pressure while allowing the main compressor to discharge at relatively low pressures.

BRIEF DESCRIPTION OF THE DRAWINGS

The invention, including its construction and method of operation, together with additional objects and advantages thereof, is illustrated schematically in the drawings, in which.

DESCRIPTION OF THE PREFERRED EMBODIMENTS

Figure 1:
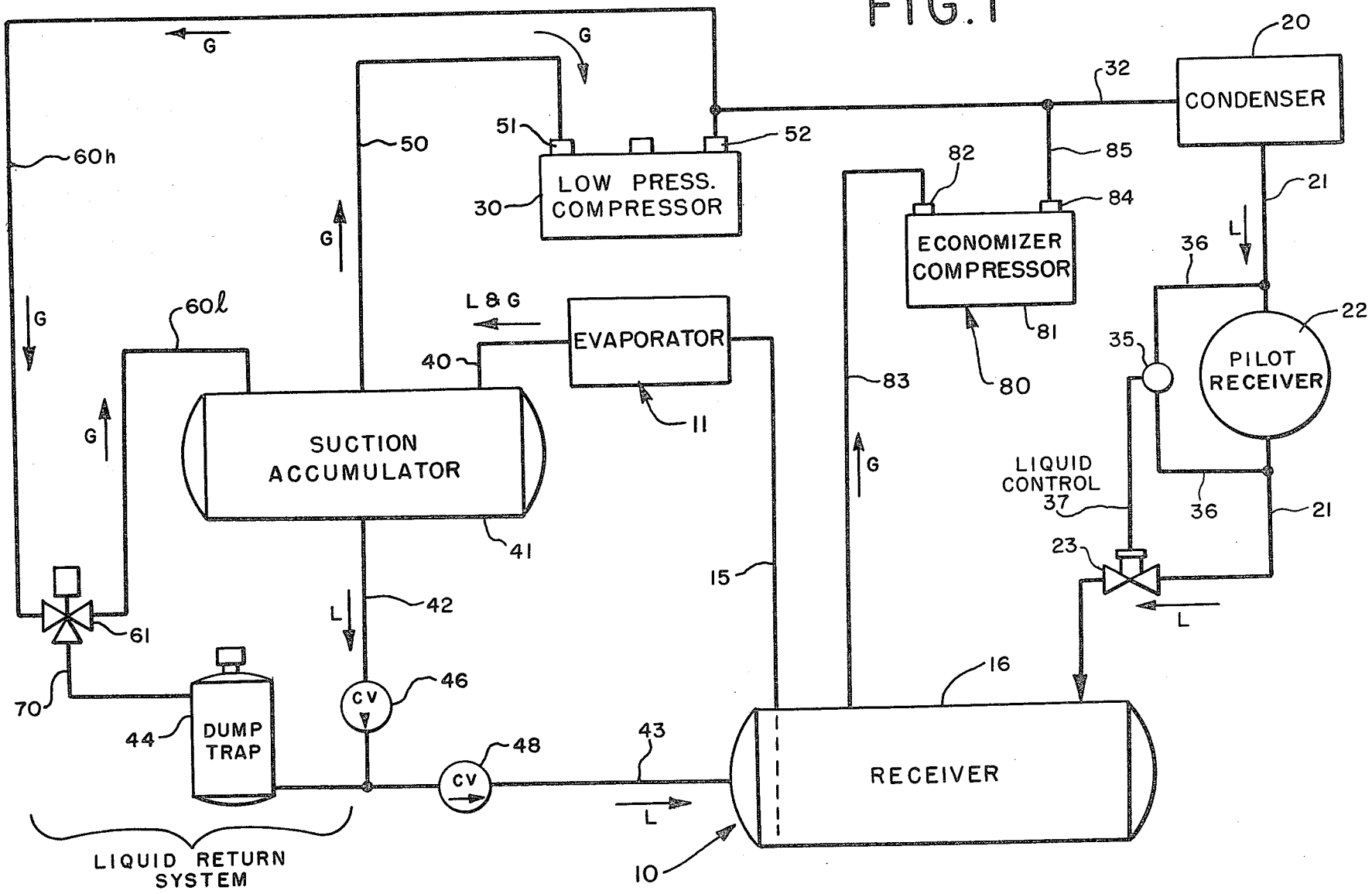
FIG. 1 is a schematic illustration of one form of a recirculating refrigeration system incorporating the improvement of the present invention.

Referring now to the drawings, and particularly to FIG. 1, a refrigeration system embodying basic features of the system disclosed in the aforementioned U.S. Pat. No. 4,059,968 is illustrated schematically at 10. The system 10 contains an improvement, however, which permits it to operate more economically than recirculating refrigeration systems presently known. In essence, the system treats flash gas which is produced during its operation in such a manner that total energy requirements for the system are substantially reduced, particularly for larger systems.

The system 10 illustrated includes an evaporator unit 11 which is adapted to receive liquid ammonia refrigerant. Typically, although adapted to use a liquid ammonia refrigerant the system 10 might use other refrigerants including halogen compounds or methanes, for example.

The evaporator 11 (which might, in fact, comprise a series of evaporators) receives refrigerant liquid through the line 15 from a receiver tank 16. The receiver tank 16, in turn, receives liquid refrigerant from a condenser 20 through a line 21 in which a pilot receiver tank 22 and control valve 23 are interposed.

The condenser 20 receives ammonia gas through a high pressure gas line 32. The condenser liquefies the hot gas by removing a substantial portion of its latent heat while the gas is under pressure. Liquid ammonia leaves the condenser 20 through the line 21.

As the liquid level rises in the pilot receiver 22 it also rises in a float valve 35. When it rises to a predetermined level the float valve 35 is effective to open the control valve 23, permitting liquid flow to the receiver 16. A pressure drop occurs across the valve 23. As a result, in a typical example, the pressure in the receiver 16 might be approximately twenty-five to fifty (25–50) PSI higher than the evaporator pressure. Condenser input pressure might be approximately one-hundred fifty (150) PSI in such a system.

Liquid refrigerant from the receiver 16 is forced to and through the evaporator 11, via the line 15, by receiver pressure. As the liquid passes through the evaporator 11 it performs its refrigerating function in a cold storage room, for example.

A combination of liquid and gaseous ammonia departs the evaporator 11 through the return line 40 to a suction accumulator 41. The accumulator 41 returns the liquid refrigerant to the receiver 16, in a manner hereinafter discussed, through a return line 42 teed into a return-feed line 43 connecting a dump tank 44 with the receiver. A check valve 46 prevents back flow of liquid ammonia in the line 42 while a check valve 48 performs the same function in the line 43.

Vaporized ammonia gas in the accumulator 41 flows through the return line 50 to a primary system compressor 30, drawn by suction from the inlet end 51 of the compressor 30. The compressor 30 is conventional and receives this gas at a low pressure; i.e., at or near evaporaor pressure, for example. The compressor 30 in the system described discharges gas from its outlet end 52 at a pressure of approximately one-hundred fifty (150) PSI, into the high pressure line 32 previously referred to.

Tapped into the high pressure output line 32 is a high pressure branch line **60*h*. The line 60*h* is connected to a three-way dump valve 61 which is, in turn, connected through a lower pressure branch line 601 back to the suction accumulator 41. The valve 61 is effective, in normal operation of the system, to block the line 60*h* and place accumulator 41 and dump tank 44 in communication through line 601 and line 70. Normally, then, pressure in the accumulator 41 and the dump tank 44 is equalized so that liquid refrigerant arriving in the accumulator 41 flows by gravity through the lines 42 and 43 into the dump tank 44**.

When the liquid in the dump tank 44 rises to a predetermined level, or accumulation in the tank is measured by a predetermined time delay, the port in the dump valve 61 which is connected to the line 70 opens so that high pressure gas flows from the line **60*h* through the line 70 into the dump tank 44. Pressure build-up in the dump tank 44 forces liquid refrigerant from the tank 44 through the line 43 and past the check valve 48 into the receiver 16**.

When the dump tank 44 has been emptied, or partially emptied, as indicated by a sensor, or after a predetermined time delay, the high pressure outlet port of the three-way dump valve 61 closes and the low pressure outlet port to the line 601 opens. Pressure in the dump tank 44 and the suction accumulator 41 is equalized. Dumping stops and liquid refrigerant again is permitted to flow by the force of gravity through the line 42 from the accumulator 41 into the dump tank 44.

The aforedescribed construction and operation of the system 10 is disclosed in the applicant's U.S. Pat. No. 4,059,968. In this sense, it is conventional. The present invention is embodied in an improvement on the aforedescribed system. The improvement is embodied in a flash gas handling sub-system 80. The sub-system 80 takes flash gas from the receiver 16 and compresses it from a substantially higher input pressure than the primary compressor 30. As a result, the load on the primary system compressor 30 is reduced.

The sub-system 80 comprises an economizer compressor 81 which has an inlet port 82 connected to the receiver 16 through a line 83. As a result, flash gas which forms in the receiver 16 is constantly being bled to the economizer compressor 81 through the line 83 to the inlet port 82.

The economizer compressor 81 also pressurizes gas to a pressure of approximately one-hundred fifty (150) PSI. It does so, however, from an input pressure substantially higher than the input pressure of the primary compressor. Pressurized gas is discharged through the outlet port 84 and a return line 85 to the high pressure line 32 and, thence, to the condenser 20.

The net effect of the sub-system 80 improvement on the system 10 is a dramatic reduction in power necessary to achieve the same amount of refrigeration. The total energy use by the two compressors in the improved system is, in practical applications, lower than the energy use of the single primary compressor in the old system.

The system 10 has been described in terms of a single receiver 16. It should, however, be understood that systems of this type could utilize multiple receivers, multiple accumulators, multiple condensers and multiple primary compressors.

Figure 2:
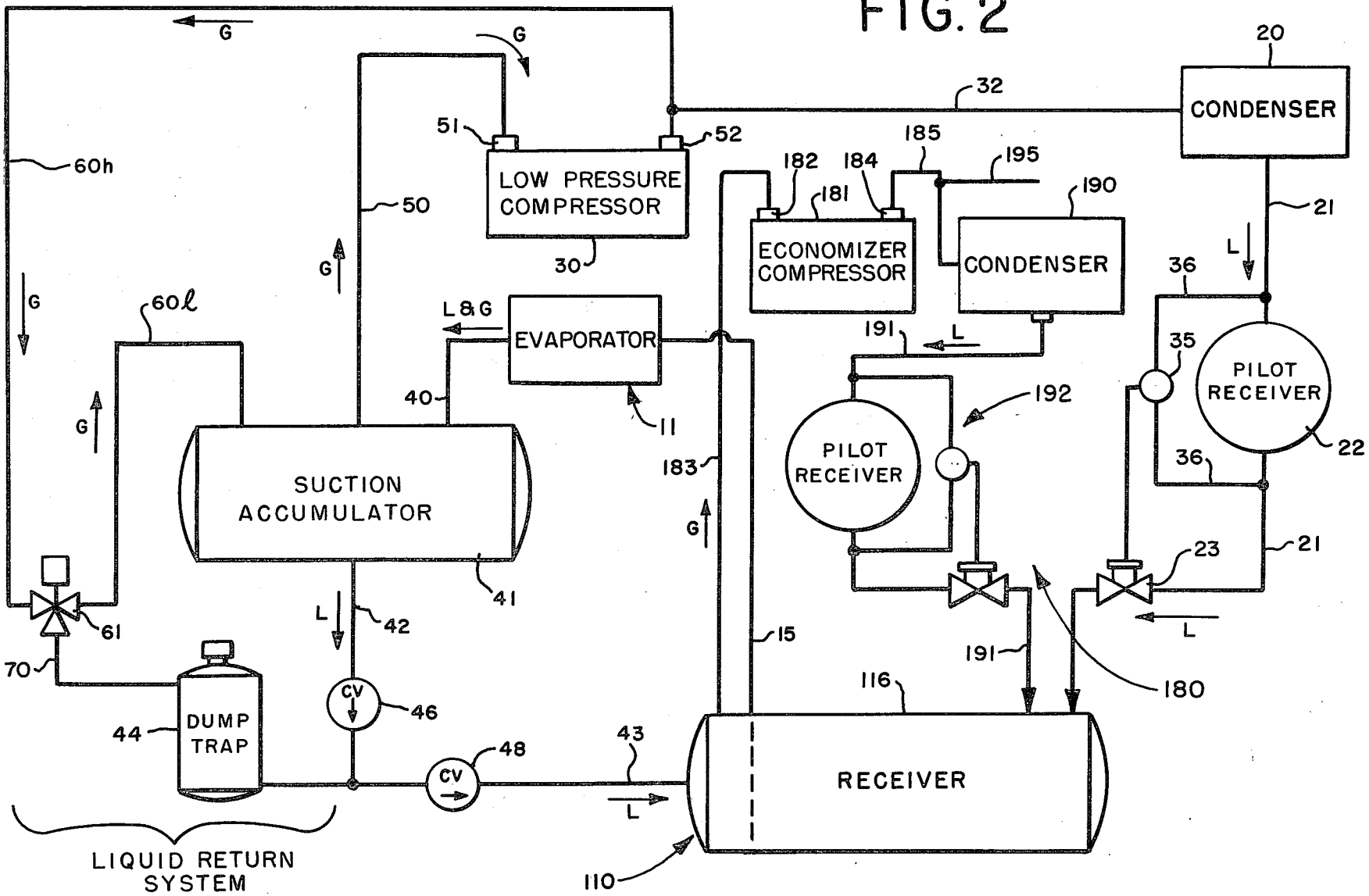
FIG. 2 is a schematic illustration of a system similar to the system of FIG. 1 with an alternative embodiment of the improvement.

Referring now to FIG. 2, a refrigeration system incorporating a modified form of the present invention is illustrated at 110. The system 110 is identical to the system 10 hereinbefore discussed with the exception that its economizer sub-system 180 is different. Accordingly, insofar as the basic system is concerned, corresponding reference numerals plus one hundred digits are utilized to designate corresponding components.

In the system 180 the economizer compressor is illustrated at 181. It has an inlet port 182 which is connected to the receiver 116 through a line 183. The economizer compressor compresses flash gas and discharges it through its outlet port 184 to the line 185. In this sense, the sub-system 180 is identical to the sub-system 80 illustrated in FIG. 1. Here the resemblence ends, however.

The compressed gas in the output line 185 is returned to an economizer condenser 190. The condenser 190 is connected back to the receiver 116 through a line 191. The flow of liquid refrigerant to the receiver 116 from the condenser 190 is regulated by a valve control group 192 identical to that previously described at 22, 23, 35, in the system 10 illustrated in FIG. 1.

As an added feature of the improvement subsystem 180 in the system 110, the output line 185 from the compressor 181 is teed into branch line 195. Through the branch line 195, gas under pressure from the economizer compressor 181, being at an elevated temperature, can be removed for defrosting or heat reclamation purposes.

I claim:

1. In a recirculating refrigeration system which includes a first compressor for compressing vaporized refrigerant received from an evaporator through a suction accumulator, a condenser for receiving compressed refrigerant vapor from said first compressor, a receiver for receiving condensed refrigerant from said condenser and supplying it to said evaporator, and means for returning unevaporaed refrigerant to the receiver means from the evaporator, the improvement comprising:

(a) a second compressor;

(b) means connecting said receiver to said second compressor through which flash gas in said receiver is transmitted to said second compressor;

(c) said second compressor being effective to compress said flash gas;

(d) a condenser which receives pressurized flash gas from said second compressor and condenses it; and (e) means for returning condensed flash gas refrigerant to said receiver.

2. The improvement in a refrigeration system of claim 1 further characterized in that:

(a) the condenser of said improvement is at least a second condenser in the refrigeration system; and (b) valve means for controlling liquid refrigerant flow from said second condenser to said receiver.

3. The improvement in a refrigeration system of claim 2 further characterized by and including:

(a) means for removing refrigerant gas under pressure at an elevated temperature from said economizer compressor for defrosting or heat reclamation purposes.

* * * * *